US010374337B2

(12) United States Patent
Tsuji et al.

(10) Patent No.: US 10,374,337 B2
(45) Date of Patent: Aug. 6, 2019

(54) TERMINAL BLOCK

(71) Applicant: OMRON Corporation, Kyoto-shi, Kyoto (JP)

(72) Inventors: Shinya Tsuji, Yamaga (JP); Yoshikazu Tajiri, Kikuchi (JP); Tatsuro Ishikawa, Kumamoto (JP); Kiyokazu Matsunaga, Kumamoto (JP)

(73) Assignee: OMRON Corporation, Kyoto-shi (JP)

( * ) Notice: Subject to any disclaimer, the term of this patent is extended or adjusted under 35 U.S.C. 154(b) by 35 days.

(21) Appl. No.: 15/786,695

(22) Filed: Oct. 18, 2017

(65) Prior Publication Data

US 2018/0183158 A1 Jun. 28, 2018

(30) Foreign Application Priority Data

Dec. 28, 2016 (JP) ..... 2016-255376

(51) Int. Cl.
*H01R 9/24* (2006.01)
*H01R 4/48* (2006.01)
*H01H 71/08* (2006.01)

(52) U.S. Cl.
CPC ..... *H01R 9/2416* (2013.01); *H01H 71/08* (2013.01); *H01R 4/4827* (2013.01);
(Continued)

(58) Field of Classification Search
CPC .... H01R 4/4827; H01R 4/4818; H01R 11/09; H01R 12/515; H01R 12/57; H01R 12/716; H01R 13/113; H01R 13/62; H01R 2201/20; H01R 31/085; H01R 4/4836; H01R 4/4845; H01R 9/2416; H01R 9/2616
See application file for complete search history.

(56) References Cited

U.S. PATENT DOCUMENTS 6,336,824 B1 * 1/2002 Sorig ..... H01R 4/4836 439/395
6,712,641 B2 * 3/2004 Beege ..... H01R 4/4836 439/441

(Continued)

FOREIGN PATENT DOCUMENTS

CN 102187521 A 9/2011
CN 106256046 A 12/2016

(Continued)

OTHER PUBLICATIONS

English Translation of WO 2015/162210.*

(Continued)

*Primary Examiner* — Edwin A. Leon
*Assistant Examiner* — Matthew T Dzierzynski
(74) *Attorney, Agent, or Firm* — Metrolex IP Law Group, PLLC

(57) ABSTRACT

A terminal block includes a housing that has an opening through which a wire is to be inserted, a terminal configured to be connected to the wire that is inserted through the opening, and a plate spring member configured to fix the wire by pressing the wire against the terminal. The plate spring member has a pressing portion configured to press the wire against the terminal, and a plastic deformation preventing portion configured to prevent the pressing portion from bending in a direction away from the terminal by more than a predetermined amount.

17 Claims, 14 Drawing Sheets

(52) U.S. Cl.
CPC ..... *H01R 4/4836* (2013.01); *H01R 4/4845* (2013.01); *H01R 4/4854* (2013.01); *H01R 9/24* (2013.01)

(56) References Cited

U.S. PATENT DOCUMENTS

| | | | | |
|---|---|---|---|---|
| 6,773,313 | B2 * | 8/2004 | Pedrinelli | H01R 4/4845 439/828 |
| 6,796,855 | B2 * | 9/2004 | Fricke | H01R 4/4818 439/835 |
| 8,251,738 | B2 * | 8/2012 | Heckert | H01R 4/4836 439/441 |
| 8,485,841 | B2 * | 7/2013 | Schrader | H01R 4/4827 439/441 |
| 8,579,651 | B2 * | 11/2013 | Hanning | H01R 4/4836 439/441 |
| 9,184,540 | B2 * | 11/2015 | Wilinski | H01R 13/629 |
| 9,373,899 | B2 * | 6/2016 | Wu | H01R 4/4818 |
| 9,553,387 | B2 * | 1/2017 | Tedeschi | H01R 13/42 |
| 9,624,951 | B2 * | 4/2017 | Wu | F16B 2/22 |
| 9,673,542 | B1 * | 6/2017 | Decker | H01R 4/4827 |
| 9,819,121 | B2 * | 11/2017 | Masaki | H01R 13/62 |
| 2003/0057621 | A1 | 3/2003 | Pedrinelli et al. | |
| 2011/0207361 | A1 | 8/2011 | Heckert et al. | |
| 2011/0312208 | A1 | 12/2011 | Hoppmann | |

FOREIGN PATENT DOCUMENTS

| | | | |
|---|---|---|---|
| DE | 2440825 | A1 | 3/1976 |
| DE | 7609673 | U1 | 7/1976 |
| DE | 7728519 | U1 | 12/1977 |
| DE | 202014101915 | U1 | 7/2015 |
| JP | 7-73913 | A | 3/1995 |
| JP | 2013-500547 | A | 1/2013 |
| WO | 2015162210 | A1 | 10/2015 |

OTHER PUBLICATIONS

The extended European search report dated Dec. 4,2017 in the counterpart European patent pplication.
The Chinese office action letter dated Mar. 4, 2019 in a counterpart Chinese patent application.

* cited by examiner

TERMINAL BLOCK

CROSS-REFERENCES TO RELATED APPLICATIONS

This application claims priority to Japanese Patent Application No. 2016-255376 filed on Dec. 28, 2016, the entire contents of which are incorporated herein by reference.

FIELD

The disclosure relates to a terminal block and particularly to a terminal block that has the function of keeping a wire and a terminal in a connected state through pressing using the restoring force of a spring.

BACKGROUND

Conventionally, a mechanism component (hereinafter referred to as a "terminal block") into which a plurality of terminals are assembled in order to connect, branch, and relay wires has been used, and various terminal blocks of different sizes and types depending on the use, such as for control panels, switchboards, and printed circuit boards, are known (for example, JP H7-73913A). To connect wires or conductors provided at leading end portions of the wires (hereinafter, collectively referred to as "wires") to terminals in these terminal blocks, a method of fixing a wire to a terminal by using a screw, a spring, or the like in a state in which the wire is crimped onto the terminal and thus electrically connecting the wire to the terminal is commonly used.

Among others, a method of fixing a wire to a terminal by using the restoring force of a plate spring has the feature that, for example, a situation in which the fixation is loosened due to vibrations and the like is unlikely to occur compared with a method of fixing the wire to the terminal by using a screw. Moreover, terminal blocks of a so-called push-in (or direct plug-in) type in which, with the use of a plate spring, the wire and the terminal can be connected to each other by simply inserting the wire into an opening portion of a housing have also been developed and have recently come into widespread use (for example, JP 2013-500547T).

FIG. 11 shows an example of a conventional terminal block that adopts the above-described method of fixing the wire to the terminal by using a plate spring. Also, FIGS. 12 and 13 are diagrams for illustrating insertion and removal of a wire into and from a terminal block shown in FIG. 11. A terminal block 9 has a housing 94, a substantially U-shaped terminal 93 that is provided along an inner wall within the housing 94 and that is open upward, a plate spring member 92, and a plastic deformation preventing portion 941 that is integrally formed with the housing.

Moreover, a wire insertion port 94*a* through which a wire 95 is to be inserted and a tool insertion port 94*b* through which a tool 98 is inserted when removing the wire are formed in an upper surface of the housing 94. An opening is formed in a bottom surface of the housing 94, and a conductor 96 is inserted from the outside of the housing through this opening.

The terminal 93 is formed of a plate-shaped member and is disposed abutting against the inner wall of the housing 94, and a connection surface 93*a* that is to be electrically connected to the inserted wire is formed facing the inside of the housing. Moreover, a connection portion 93*b* that is connected to the conductor 96 inserted from the outside of the housing is formed in a bottom surface portion of the terminal block 9.

The plate spring member 92 is formed by bending a band-shaped plate spring into a substantially V-shape, and is disposed such that one flat plate portion 92*b* abuts against an inner wall of the terminal 93 on a lateral side that opposes the connection surface 93*a*, a leading end portion 92*a* of another flat plate portion 92*c* abuts against substantially the middle of the connection surface 93*a* of the terminal, and a bent portion 92*d* of the V-shape faces diagonally upward of the housing.

The plastic deformation preventing portion 941 is a member that is located at substantially the center of the bottom surface of the housing and protrudes upward from the bottom surface to a predetermined height.

When connecting the wire 95 to the terminal block 9, a leading end portion 95*a* of the wire 95 is inserted through the wire insertion port 94*a*, and as shown in FIG. 12, the leading end portion 92*a* of the plate spring member 92 is pressed by the leading end portion 95*a* against the restoring force of the spring so as to widen a gap between the terminal 93 and the leading end portion 92*a* of the plate spring member 92, and thus, the leading end portion 95*a* is pushed into the gap. Then, due to the restoring force of the leading end portion 92*a* of the plate spring member 92, the leading end portion 92*a* presses the leading end portion 95*a* of the wire 95 against the connection surface 93*a* of the terminal and thereby fixes the wire 95. As a result, the wire 95 is connected to the terminal 93, and if a force in a withdrawal direction is applied to the wire 95, an edge of the leading end portion 92*a* of the plate spring member 92 bites into the surface of the leading end portion 95*a* of the wire 95, so that the wire 95 is prevented from being removed.

When detaching the wire from the terminal block 9, as shown in FIG. 13, the tool 98, such as a slotted screwdriver, is inserted through the tool insertion port 94*b* of the housing 94, and the flat plate portion 92*c* of the plate spring member 92 is pushed downward against the restoring force of the spring to separate the leading end portion 92*a* from the wire 95. As a result, the wire 95 is released from the plate spring member 92 and can therefore be removed (detached) from the terminal block 9.

It should be noted that during insertion of the wire 95 as well, when the leading end portion 95*a* of the wire cannot be pushed in for insertion due to a lack of rigidity, the plate spring member 92 is pushed downward in the same manner as in removal of the wire, and in this state, even a wire that is not rigid, such as a stranded wire, can be inserted.

Moreover, when the plate spring member 92 is pushed downward by a tool as described above, deformation of the spring is restricted within a predetermined range by the plastic deformation preventing portion 941. Thus, the spring can be prevented from exceeding the elastic limit of the spring and plastically deforming due to excessive force being applied to the spring during insertion of a tool.

JP H7-73913A and JP 2013-500547T are examples of background art.

Incidentally, in the case where the strength of the above-described plastic deformation preventing portion 941 is insufficient, if a force at or above a predetermined level is applied to the plastic deformation preventing portion 941 when the tool is inserted and pushes the spring downward, the plastic deformation preventing portion 941 may be damaged and lose the function of preventing plastic deformation of the spring, and hence, the terminal block itself can no longer be used.

Conventional members for preventing plastic deformation, such as that described above, are often molded out of a synthetic resin. Therefore, if an attempt to achieve a smaller and slimmer terminal block is made, sufficient strength of the plastic deformation preventing portion cannot be obtained. On the other hand, if an attempt to obtain sufficient strength is made, the size of the plastic deformation preventing portion increases, and thus, a problem arises in that the degree of freedom of design of other members decreases. Moreover, if the plastic deformation preventing portion is composed of a metal or the like that is separate from the housing, the manufacturing cost increases.

SUMMARY

One or more embodiments has been made in view of the above-described circumstances, and one or more embodiments may provide a plastic deformation preventing mechanism for a plug-in type terminal block that uses a plate spring, the plastic deformation preventing mechanism having excellent durability while increasing the degree of freedom of design of the terminal block.

One or more embodiments employ the following configurations.

A terminal block according to one or more embodiments is a terminal block including a housing that has an opening through which a wire is to be inserted, a terminal configured to be connected to the wire that is inserted through the opening, and a plate spring member configured to fix the wire by pressing the wire against the terminal, wherein the plate spring member has a pressing portion configured to press the wire against the terminal and a plastic deformation preventing portion configured to prevent the pressing portion from bending in a direction away from the terminal by more than a predetermined angle.

With this configuration, the plate spring itself prevents the spring from exceeding the elastic limit of the spring and plastically deforming. This structure eliminates the need to separately provide means for preventing plastic deformation, and can increase the degree of freedom of design of the terminal block. Moreover, due to the strength of the plate spring itself, sufficient strength of the plastic deformation preventing portion can be secured.

The plastic deformation preventing portion may include an end surface of the plate spring member, and when the pressing portion bends in the direction away from the terminal by the predetermined amount, the pressing portion may be prevented from bending any further by abutting the end surface of the plate spring member against a portion of the plate spring member. With this configuration, the force is received by the end surface of the plate-shaped member, and thus deformation of the plastic deformation preventing portion itself can be suppressed more reliably.

Moreover, the plate spring member may have bent portions at a plurality of positions in a longitudinal direction and may be disposed such that, in a state prior to deformation, an inner surface of a first end portion of the plate spring member with respect to the longitudinal direction opposes an end surface of a second end portion of the plate spring member with respect to the longitudinal direction via a gap, the pressing portion may be configured by a region that contains the first end portion of the plate spring member with respect to the longitudinal direction, the plastic deformation preventing portion may be configured by a region that contains the second end portion of the plate spring member with respect to the longitudinal direction, and when the pressing portion of the plate spring member bends by the predetermined amount, the inner surface of the first end portion of the plate spring member with respect to the longitudinal direction may abut against the end surface of the plastic deformation preventing portion, which is the region that contains the second end portion of the plate spring member with respect to the longitudinal direction.

With this configuration, a function for preventing plastic deformation can be imparted to the plate spring itself by simply changing the bend angle and the length of a plate spring used in a conventional terminal block, and thus, the costs involved in design and manufacturing can be suppressed.

Furthermore, the plate spring member may have two bent portions in the longitudinal direction, may have a triangular shape with the vicinity of one vertex being open when viewed in a width direction of the plate spring, and may be disposed such that, in a state prior to deformation, an inner surface of an end portion of a first one of two sides of the triangular shape that are located on opposite sides of the opening opposes an end surface of an end portion of a second one of the two sides via a gap, and the pressing portion may be configured by a region that contains the end portion of the first one of the two sides of the triangular shape that are located on the opposite sides of the opening, the plastic deformation preventing portion may be configured by a region that contains the end portion of the second one of the two sides of the triangular shape that are located on opposite sides of the opening, and when the pressing portion of the plate spring member bends by the predetermined amount, the inner surface of the end portion of the first one of the two sides of the triangular shape that are located on the opposite sides of the opening may abut against the end surface of the end portion of the second one of the two sides of the triangular shape that are located on the opposite sides of the opening. In this manner, a plastic deformation preventing function with sufficient strength can be secured while simplifying the configuration of the plate spring member even more.

Moreover, the terminal block may further have a support for the plastic deformation preventing portion, the support being configured to prevent displacement and/or deformation of the plastic deformation preventing portion. With this configuration, the plastic deformation preventing portion itself can be prevented from being displaced or deformed due to bending or the like, so that plastic deformation of the plate spring member can be more reliably prevented.

According to one or more embodiments, it is possible to provide a plastic deformation preventing mechanism for a plug-in type terminal block that uses a plate spring, the plastic deformation preventing mechanism having excellent durability while increasing the degree of freedom of design of the terminal block.

DETAILED DESCRIPTION

Hereinafter, a mode for carrying out one or more embodiments will be described in detail by way of example based on embodiments below. However, unless otherwise specified, the dimensions, materials, shapes, relative arrangement, and the like of constituent components described in these embodiments are not intended to limit the scope of the present invention to only those described below.

Embodiment 1

Configuration Example of Terminal Block

First, the configuration of a terminal block 1 according to one or more embodiments will be described with reference to FIG. 1.

Figure 1:
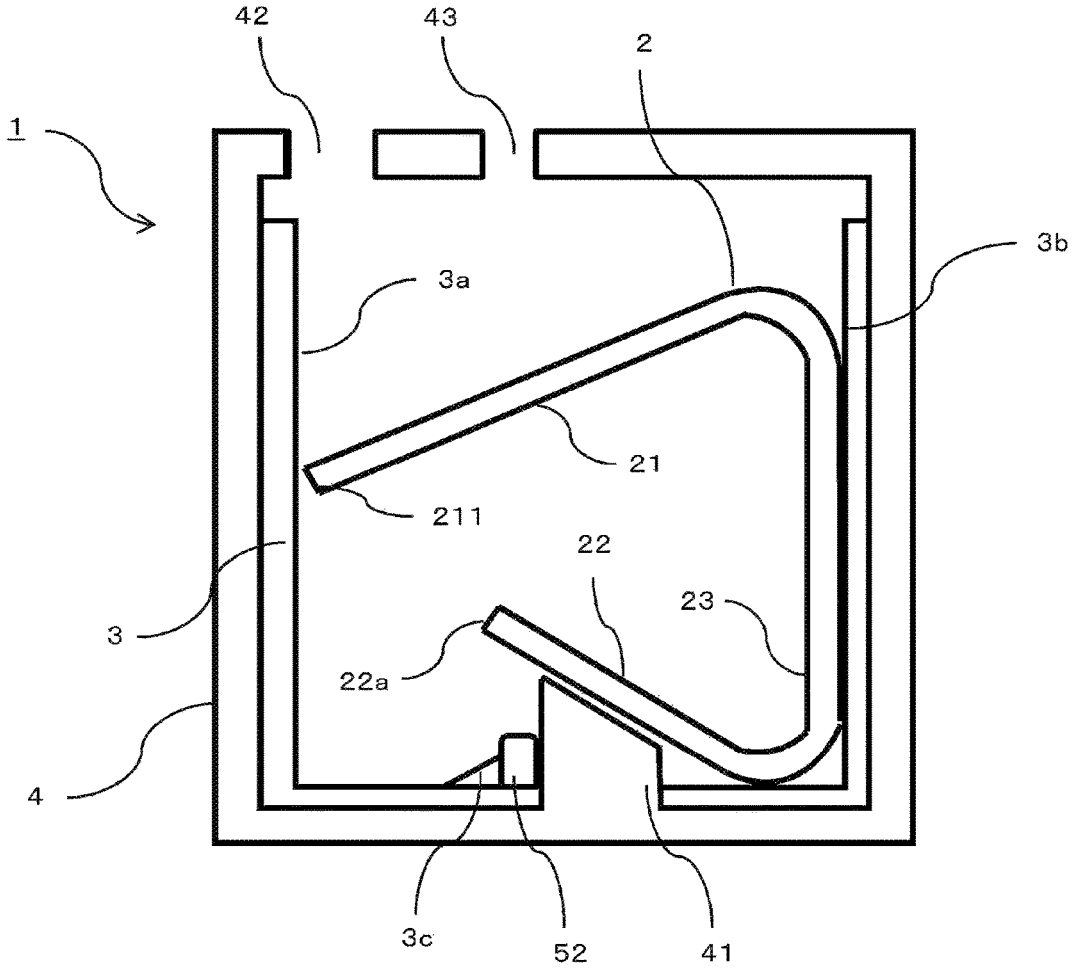
FIG. 1 is a cross-sectional view showing a terminal block according to Embodiment 1.

FIG. 1 is a cross-sectional view showing an internal structure of the terminal block 1 according to one or more embodiments. The terminal block 1 has, as main constituents, a housing 4, a substantially U-shaped terminal 3 that is disposed along an inner wall of the housing 4 and that is open upward, and a plate spring member 2.

The housing 4 is molded out of a resin, for example, and a wire insertion port 42 through which a wire 5 is to be inserted and a tool insertion port 43 through which a tool 8 is to be inserted when removing the wire are formed in an upper surface of the housing 4. Moreover, an opening is formed near the center of a bottom surface of the housing 4, and a conductor 52 is inserted from the outside of the housing via this opening. Furthermore, a support 41 for a plastic deformation preventing portion is formed in the bottom surface. The support 41 for a plastic deformation preventing portion is a protrusion having such a slope that conforms to a lower surface of a plastic deformation preventing portion 22 of the plate spring member 2, which will be described later.

The terminal 3 is, for example, a plate-shaped member made of a conductive metal such as copper and is disposed abutting against the inner wall of the housing 4, and a connection surface 3*a* thereof that is to be electrically connected to the inserted wire 5 is formed facing the inside of the housing. Moreover, a connection portion 3*c* to be connected to the conductor 52 is formed in a bottom surface portion. Furthermore, in the bottom surface portion, a cut-out portion for the protruding support 41 for a plastic deformation preventing portion is formed in the bottom surface portion.

The plate spring member 2 is formed by bending a band-shaped plate spring made of a material such as stainless steel, for example, into a triangular shape with one side being partially cut out and the vicinity of one vertex being open when viewed from a width direction of the plate spring. A flat plate portion corresponding to one of the other sides of the triangular shape that are not partially cut out serves as a fixation portion 23 and is fixed to a surface 3*b* of the terminal 3 that is located on the side opposite to the connection surface 3*a*. Moreover, a flat plate portion constituting the other side of the two sides that are not partially cut out is an elastic deformation portion 21, and a leading end portion thereof is disposed in such a manner as to abut against the connection surface 3*a* of the terminal 3. This leading end portion corresponds to a pressing portion 211, which will be described later, the pressing portion 211 pressing the wire 5 against the connection surface 3*a*. Moreover, a flat plate portion constituting the partially cut-out side of the triangular shape is the plastic deformation preventing portion 22, and a leading end surface 22*a* of the plastic deformation preventing portion 22 restricts the elastic deformation portion 21 from bending more than a predetermined distance in a direction away from the connection surface 3*a* of the terminal.

Usage

Next, a usage example of the terminal block 1 according to one or more embodiments will be described using FIGS. 2 and 3.

Figure 2:
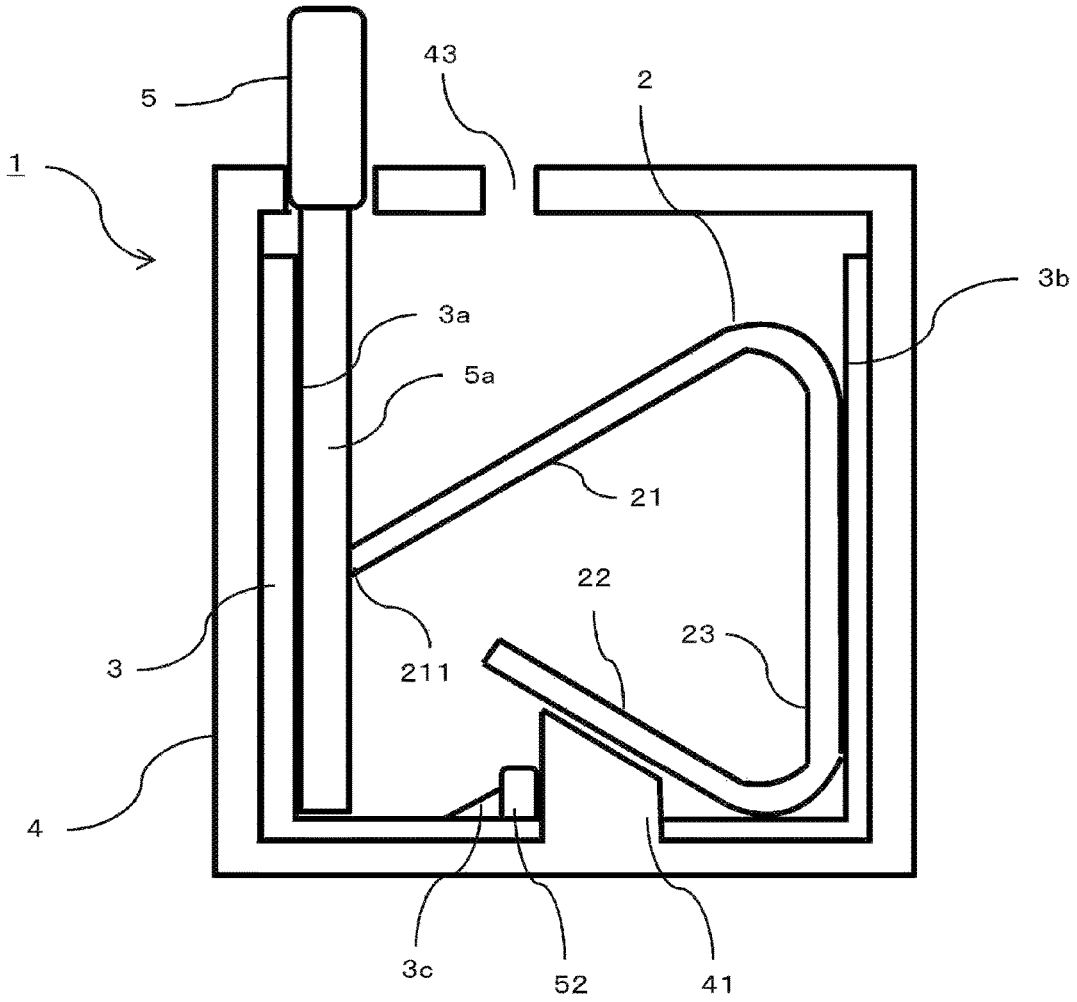
FIG. 2 is a diagram illustrating a case where a wire is connected to a terminal block, such as in FIG. 1.

FIG. 2 is a diagram illustrating the relationship between the terminal block 1 and the wire 5 in the case where the wire 5 is connected to the terminal block 1. A leading end portion 5*a* of the wire 5 is inserted through the wire insertion port 42. Then, as shown in FIG. 2, a gap between the pressing portion 211 of the plate spring member 2 and the connection surface 3*a* of the terminal 3 is widened (i.e., the elastic deformation portion 21 is elastically deformed) against the restoring force of the spring by the leading end portion 5*a*, and the leading end portion 5*a* is pushed into the gap between the connection surface 3*a* of the terminal and the pressing portion 211 of the plate spring member 2. As a result, the pressing portion 211 presses the leading end portion 5*a* of the wire 5 against the connection surface 3*a* of the terminal 3 utilizing the restoring force of the plate spring member 2 and therefore fixes the wire 5. Thus, the leading end portion 5*a* of the wire 5 is connected to the terminal 3, and if a force in the withdrawal direction is applied to the wire 5, an edge of the pressing portion 211 bites into the surface of the leading end portion 5*a* of the wire 5, so that the wire 5 is prevented from being removed.

Figure 3:
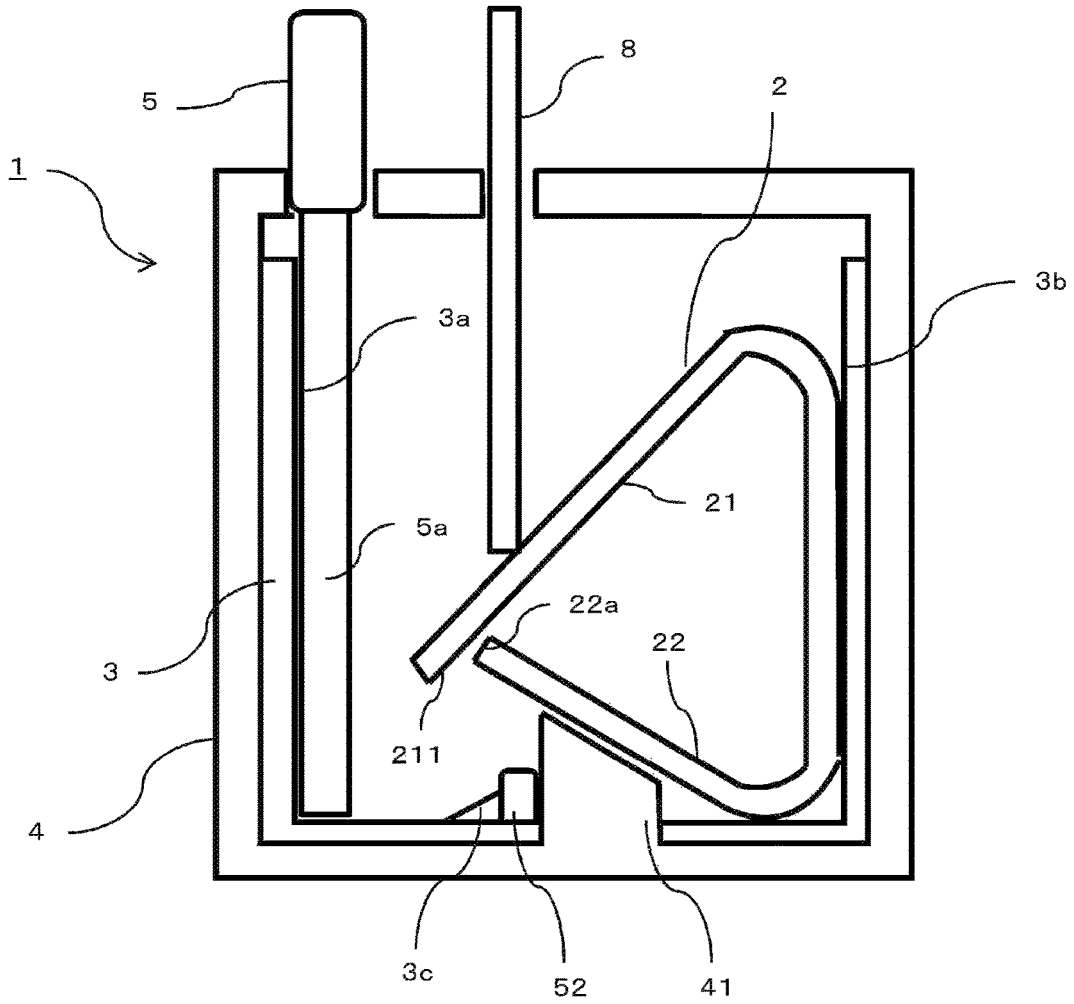
FIG. 3 is a diagram illustrating a case where a wire connected to a terminal block, such as in FIG. 2, is to be removed.

FIG. 3 is a diagram showing the relationship between the terminal block 1 and the wire 5 in the case where the wire 5 is to be detached from the terminal block 1. When detaching the wire 5 from the terminal block 1, as shown in FIG. 3, the tool 8, which is a slotted screwdriver or the like, is inserted through the tool insertion port 43 of the housing 4. Then, the elastic deformation portion 21 of the plate spring member 2 is pushed downward against the restoring force of the spring to separate the pressing portion 211 from the wire. Thus, the wire 5 is released from the plate spring member 2 and can be detached from the terminal block 1.

It should be noted that during insertion of the wire 5 as well, if the leading end portion 5*a* of the wire 5 cannot be pushed in for insertion due to a lack of rigidity, the elastic deformation portion 21 of the plate spring member 2 is pushed downward in the same manner as when the wire 5 is removed, and in this state, even a wire that is not rigid, such as a stranded wire, can be inserted into the terminal block 1. Then, after the leading end portion 5*a* of the wire 5 has been inserted, the tool 8 is withdrawn. As a result, the elastic deformation portion 21 presses the leading end portion 5*a* of the wire 5 against the connection surface 3*a* of the terminal using the restoring force thereof, and thus, the wire 5 and the terminal 3 are connected and fixed to each other.

Here, when the elastic deformation portion 21 of the plate spring member 2 is pushed downward by the tool 8 as described above, bending (i.e., deformation) of the elastic deformation portion 21 is restricted due to the elastic deformation portion 21 abutting against the leading end surface 22*a* of the plastic deformation preventing portion 22. That is to say, the elastic deformation portion 21 elastically deforms up to the distance to the leading end surface 22*a* of the plastic deformation preventing portion 22, and even if a force that would deform the pressing portion 221 in the direction away from the connection surface 3*a* of the terminal more than that distance is applied, the elastic deformation portion 21 does not deform any further because it is supported by the plastic deformation preventing portion 22. Thus, even if excessive force is applied during insertion of the tool 8, plastic deformation of the plate spring member 2 due to the elastic deformation portion 21 deforming beyond its elastic limit can be prevented.

Moreover, the plastic deformation preventing portion 22 itself is positioned and fixed by the support 41 for a plastic deformation preventing portion, the support 41 being provided near the center of the bottom surface portion of the housing 4. Thus, a phenomenon in which the plastic deformation preventing portion 22 undergoes bending or the like and the elastic deformation portion 21 cannot be sufficiently supported can be prevented.

As described above, with the configuration of the terminal block 1 according to one or more embodiments, in which the force of the tool does not act directly, but acts in a longitudinal direction of the plate spring member 2, a terminal block including a plastic deformation preventing mechanism that is unlikely to be damaged or deformed can be provided without using a dedicated member (i.e., by simply changing the shape of a plate spring of a conventional terminal block), and the degree of freedom of design of the terminal block can be increased without an increase in the manufacturing cost.

Modification 1

It should be noted that although the terminal block 1 according to Embodiment 1 above adopts a configuration in which the elastic deformation portion 21 of the plate spring member 2 is received by the leading end surface 22*a* of the plastic deformation preventing portion 22, such a configuration does not necessarily have to be adopted, and elastic deformation of the plate spring member may also be restricted by using the following configuration.

Figure 4:
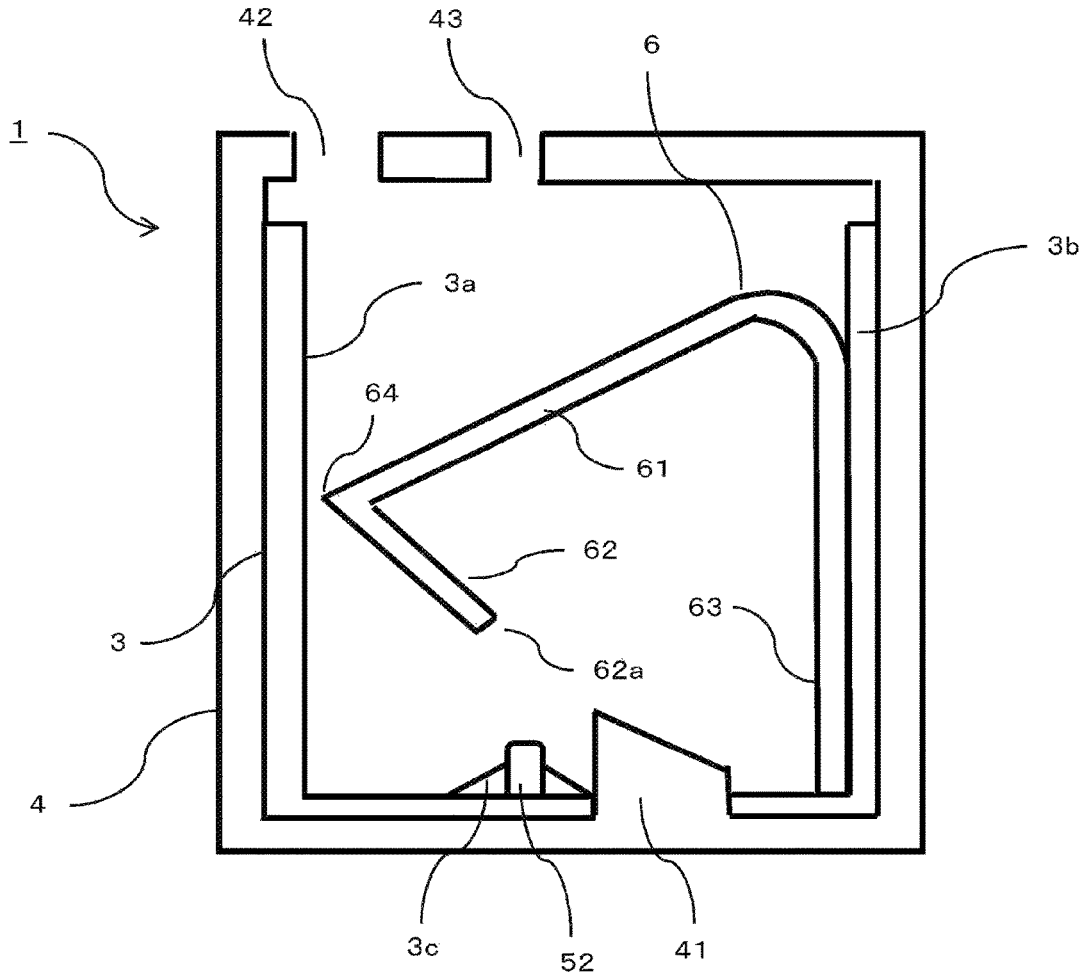
FIG. 4 is a cross-sectional view showing a first modification of a terminal block according to Embodiment 1.

FIG. 4 is a cross-sectional view showing an internal structure of the terminal block 1 according to a first modification of Embodiment 1. As shown in FIG. 4, a plate spring member 6 is formed by bending a band-shaped plate spring into a triangular shape with one side being partially cut out and the vicinity of one vertex being open when viewed from the width direction of the plate spring. A flat plate portion corresponding to one of the sides of the triangle that are not partially cut out serves as a fixation portion 63 and is fixed to the surface 3*b* of the terminal 3 that is located on the opposite side to the connection surface 3*a*. A flat plate portion constituting the other of the sides that are not partially cut out serves as an elastic deformation portion 61. A flat plate portion constituting the partially cut-out side of the triangle serves as a plastic deformation preventing portion 62. Moreover, a corner portion that is formed by a leading end portion of the elastic deformation portion 61 and a leading end portion of the plastic deformation preventing portion 62 serves as a pressing portion 64.

The pressing portion 64 is disposed in such a manner as to abut against the connection surface 3*a* of the terminal 3, and has the function of pressing, with an edge portion thereof, the leading end portion 5*a* of the wire 5 against the connection surface 3*a*. The plastic deformation preventing portion 62 restricts the elastic deformation portion 61 from bending in the direction away from the connection surface 3*a* of the terminal 3 by more than a predetermined angle, as a result of a leading end surface 62*a* of the plastic deformation preventing portion 62 abutting against the fixation portion 63.

Figure 5:
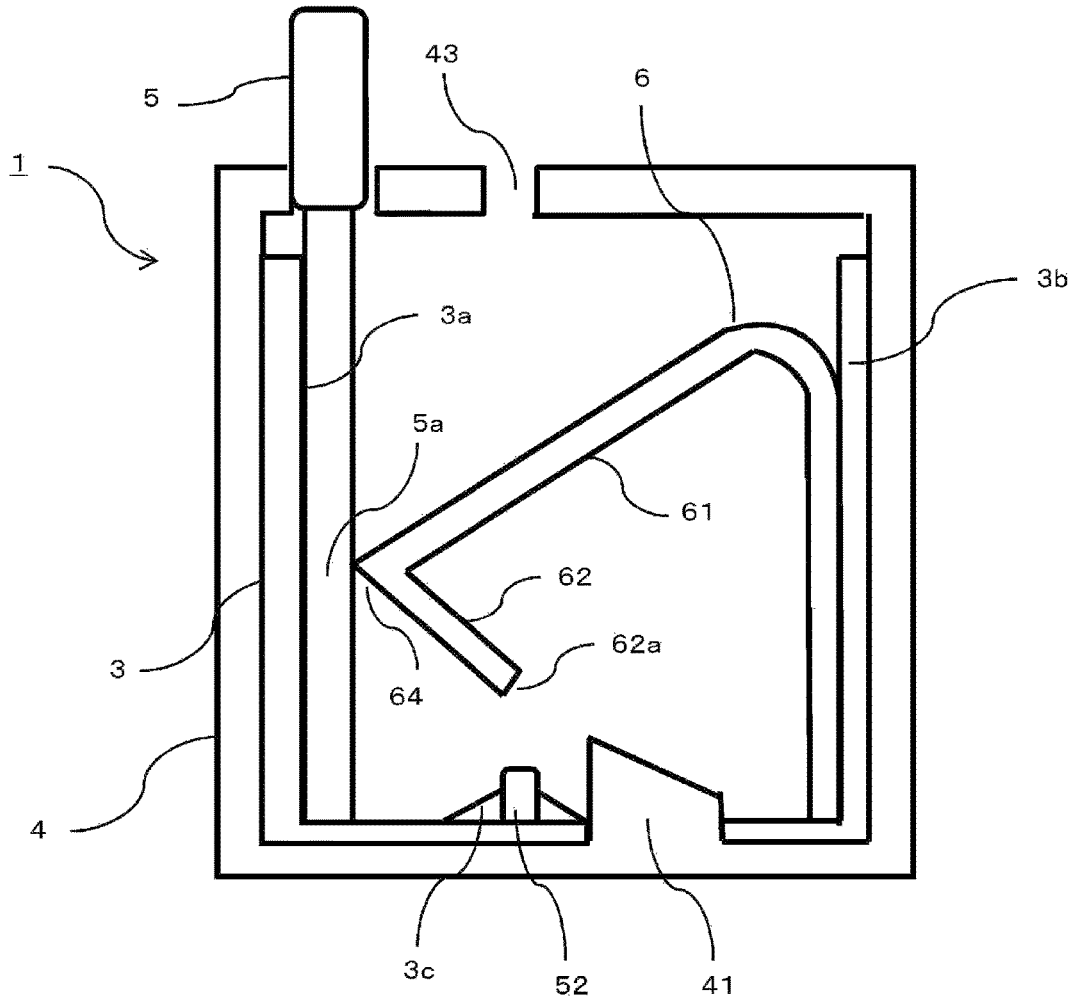
FIG. 5 is a diagram illustrating a case where a wire is connected to a terminal block, such as in FIG. 4.

FIG. 5 is a diagram showing the relationship between the terminal block 1 and the wire 5 in the case where the wire 5 is connected to the terminal block 1. The leading end portion 5*a* of the wire 5 is inserted through the wire insertion port 42*a*. Then, as shown in FIG. 5, a gap between the pressing portion 64 of the plate spring member 6 and the connection surface 3*a* is widened (i.e., the elastic deformation portion 61 is elastically deformed) against the restoring force of the spring by the leading end portion 5*a*, and the leading end portion 5*a* is pushed into the gap between the connection surface 3*a* of the terminal and the pressing portion 64 of the plate spring member 6. As a result, the pressing portion 64 presses the leading end portion 5*a* of the wire 5 against the connection surface 3*a* of the terminal utilizing the restoring force of the plate spring member 6, and thus fixes the wire 5.

Figure 6:
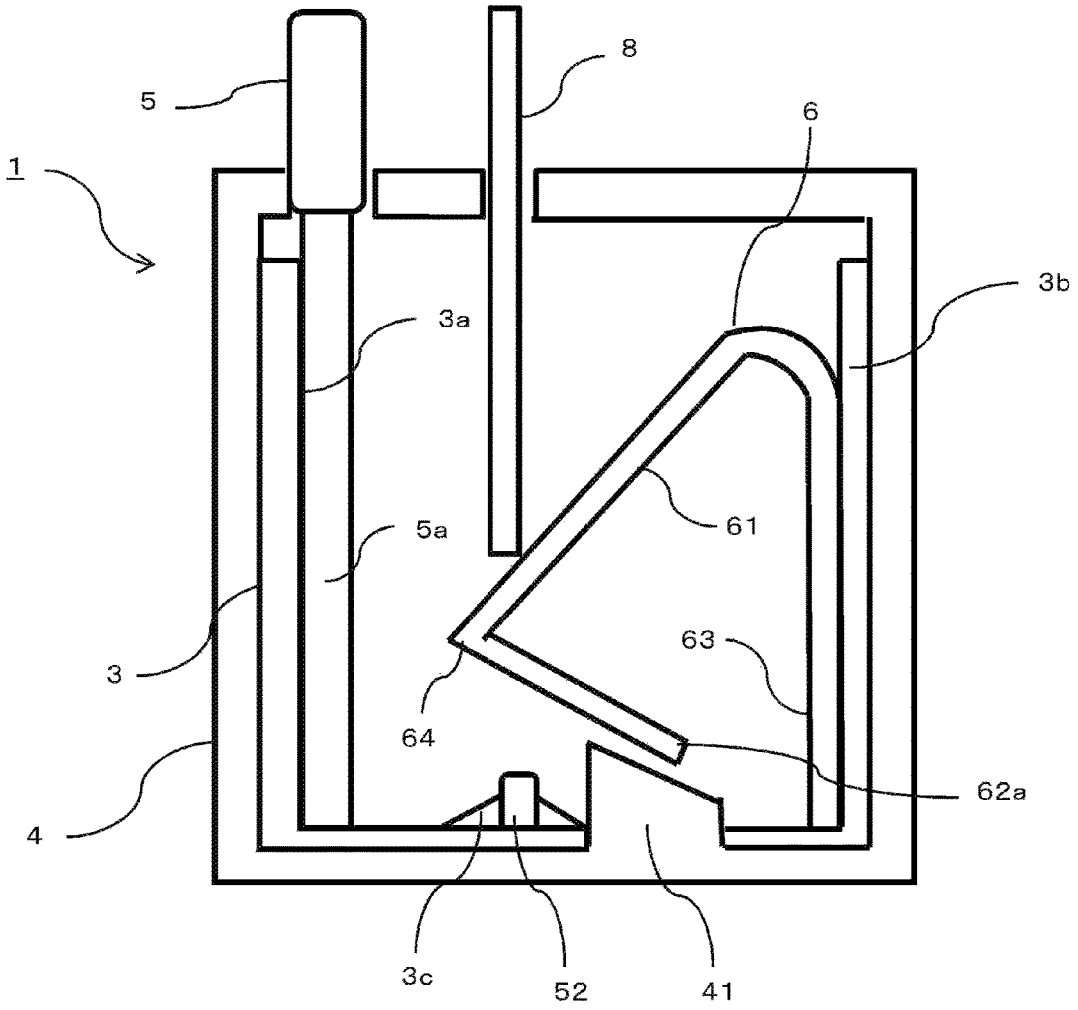
FIG. 6 is a diagram illustrating a case where a wire connected to a terminal block, such as in FIG. 5, is to be removed.

FIG. 6 is a diagram showing the relationship between the terminal block 1 and the wire 5 when the pressing portion 64 is separated from the connection surface 3*a* of the terminal 3 in the case where, for example, the wire 5 is to be detached from the terminal block 1, or a wire with insufficient rigidity, such as a stranded wire, is to be inserted. In such cases, as shown in FIG. 6, the tool 8, which is a slotted screwdriver or the like, is inserted through the tool insertion port 43 of the housing. Then, the elastic deformation portion 61 of the plate spring member 6 is pushed downward against the restoring force of the spring to separate the pressing portion 64 from the connection surface 3*a*. Consequently, it is possible to detach the fixed wire or insert a wire with insufficient rigidity.

Here, when the elastic deformation portion 61 of the plate spring member 6 is pushed downward by the tool 8 as described above, deformation of the elastic deformation portion 61 is restricted by the leading end surface 62*a* of the plastic deformation preventing portion 62, which is connected to the elastic deformation portion 61 via the pressing portion 64, abutting against the fixation portion 63. That is to say, the elastic deformation portion 61 elastically deforms up to a distance at which the leading end surface 62*a* of the plastic deformation preventing portion 62 abuts against the fixation portion 63, and even if a force that would deform the pressing portion 64 in the direction away from the connection surface 3*a* of the terminal more than that distance is applied, the elastic deformation portion 61 does not deform any further because the plastic deformation preventing portion 62 is supported by the fixation portion 63 and the support 41 for a plastic deformation preventing portion.

Thus, even if excessive force is applied during insertion of the tool 8, plastic deformation of the plate spring member 6 due to the elastic deformation portion 61 deforming beyond its elastic limit can be prevented.

Modification 2

In the foregoing examples, the plate spring member is formed by bending a band-shaped plate spring into a triangular shape with the vicinity of one vertex being open when viewed in the width direction of the plate spring. However, the shape of the plate spring member is not limited to this, and may also be a shape such as that shown in FIGS. 7A, 7B, and 8, for example.

Figure 7A:
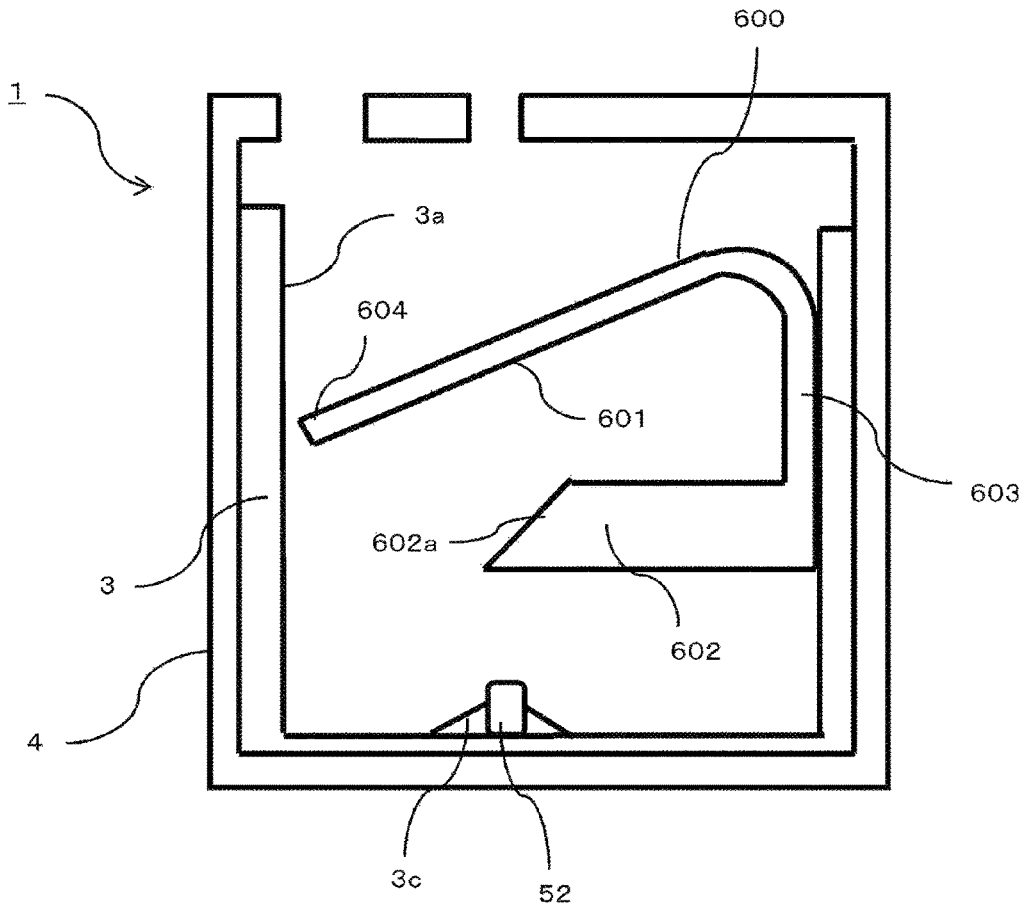
FIG. 7A is a cross-sectional view showing a second modification of a terminal block according to Embodiment 1.
Figure 7B:
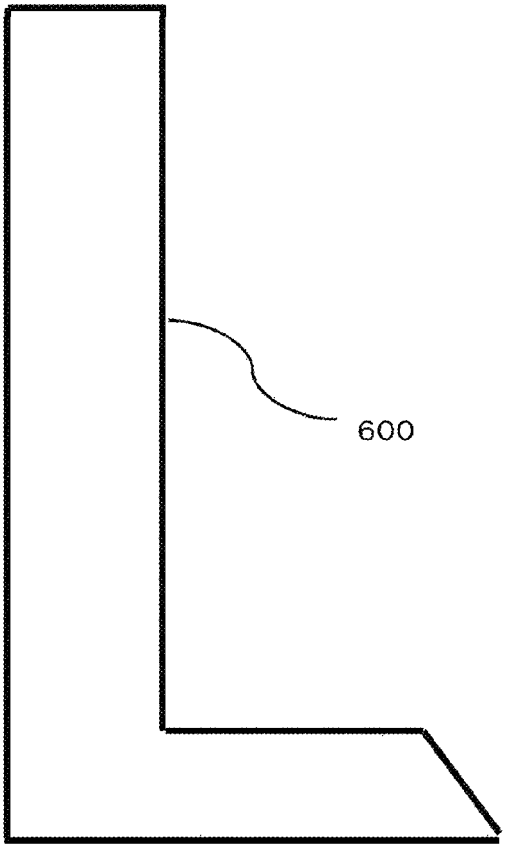
FIG. 7B is a diagram showing the shape of a plate spring member of a terminal block, such as in FIG. 7A.

FIG. 7A is a cross-sectional view showing an internal structure of the terminal block 1 according to a second modification of Embodiment 1. As shown in FIG. 7B, a plate spring member 600 of the terminal block 1 according to the present modification has a shape obtained by bending a short side portion of a plate spring having a substantially L-shape in plan view by 90 degrees, and curving a long side portion thereof. The bent short side corresponds to a plastic deformation preventing portion 602. A side of the curved long side portion that is connected to the short side portion corresponds to a fixation portion 603, another side of the curved long side portion corresponds to an elastic deformation portion 601, and a leading end portion of the elastic deformation portion 601 corresponds to a pressing portion 604.

Figure 8:
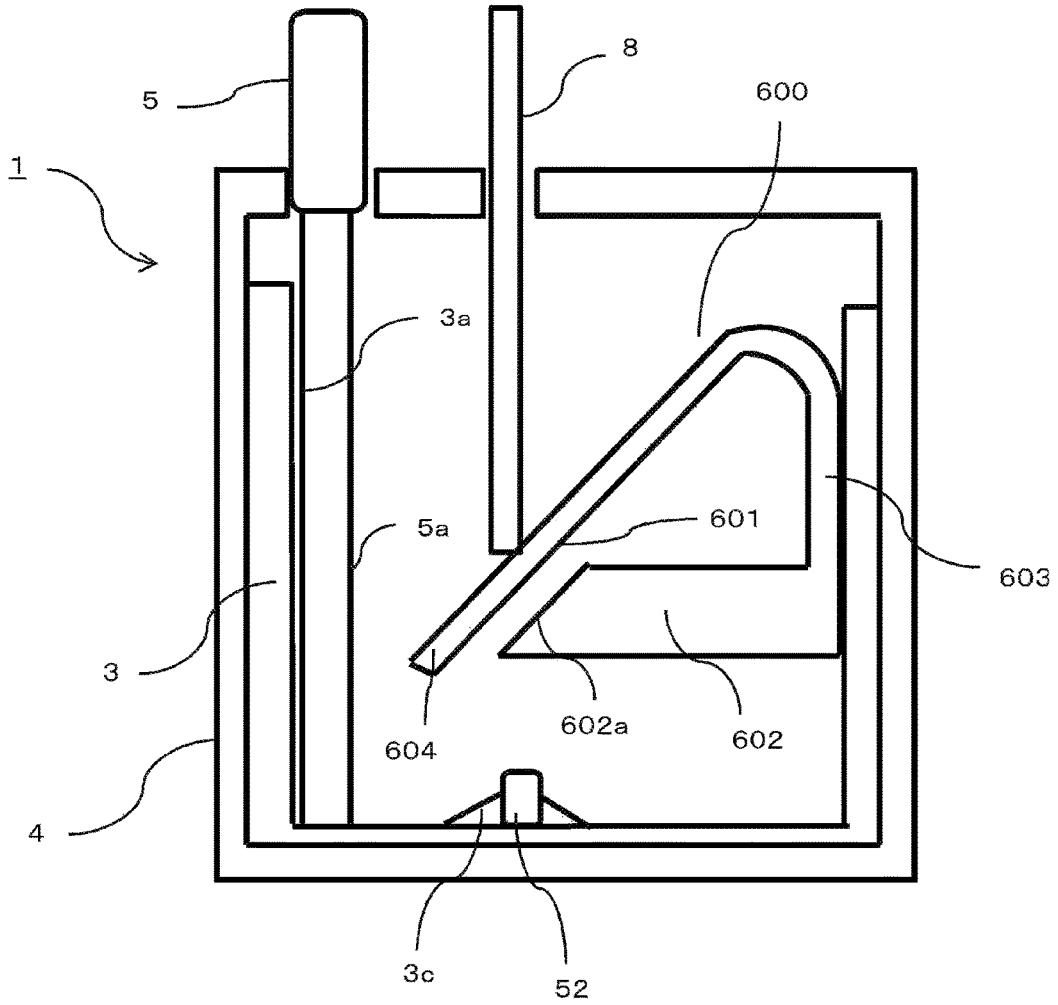
FIG. 8 is a diagram illustrating a case where a wire connected to a terminal block, such as in FIG. 7A, is to be removed.

FIG. 8 is a diagram showing the relationship between the terminal block 1 and the wire 5 when the pressing portion 604 is separated from the connection surface 3*a* of the terminal 3 in the case where, for example, the wire 5 is to be detached from the terminal block 1, or a wire with insufficient rigidity, such as a stranded wire, is to be inserted. As shown in FIG. 8, when the elastic deformation portion 601 of the plate spring member 600 is pushed downward by the tool 8, deformation of the elastic deformation portion 601 is restricted by abutting against a leading end surface 602*a* of the plastic deformation preventing portion 602. In this manner, even if excessive force is applied during insertion of the tool 8, plastic deformation of the plate spring member 600 due to the elastic deformation portion 601 deforming beyond its elastic limit can be prevented.

It should be noted that the leading end portion of the plastic deformation preventing portion 602 has a shape that slopes at a predetermined angle so that the leading end portion can appropriately abut against the elastic deformation portion 601. Moreover, since the plastic deformation preventing portion 602 is supported by a wall surface portion of the housing 4, the terminal block 1 according to the present modification can also be configured without a support for a plastic deformation preventing portion.

Embodiment 2

Next, a second embodiment will be described based on FIGS. 9 and 10. It should be noted that since many constituent elements of a terminal block 11 according to one or more embodiments are the same as those of the terminal block 1 according to Embodiment 1, those constituent elements are denoted by the same reference numerals as those of the terminal block 1 according to Embodiment 1, and their detailed description is omitted.

Figure 9:
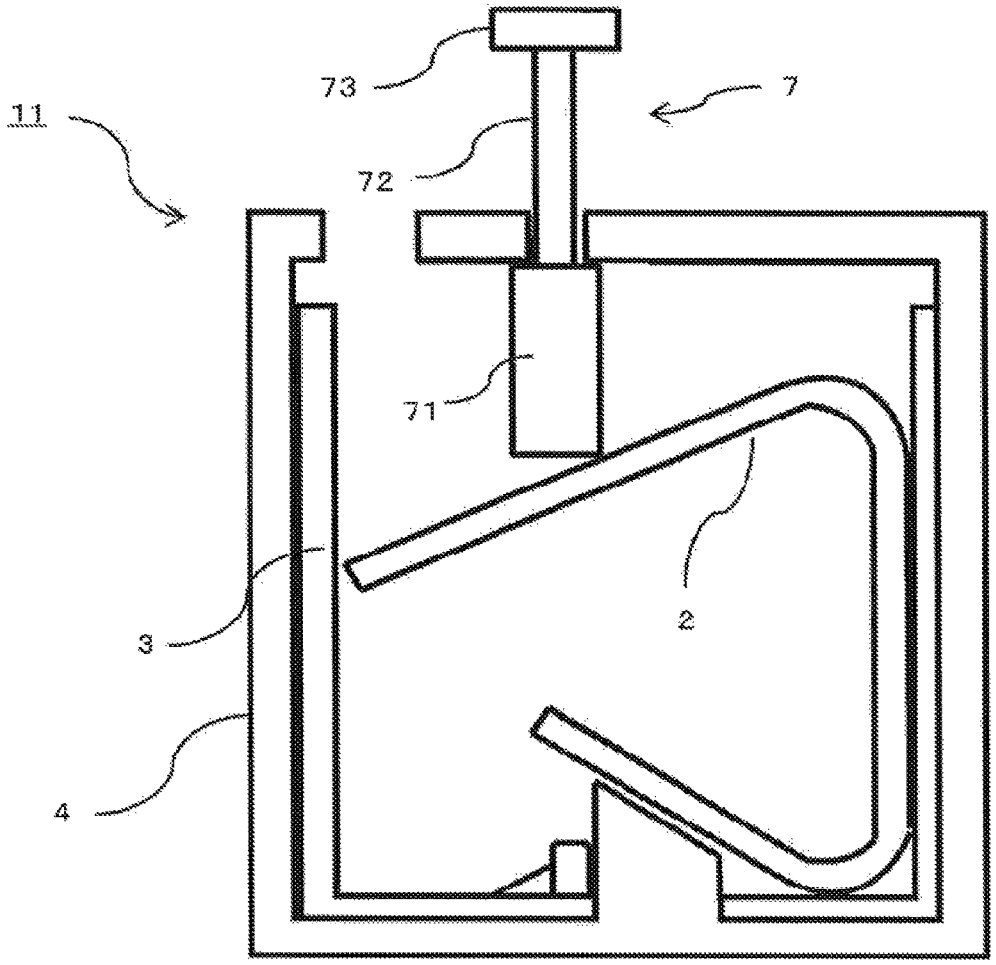
FIG. 9 is a cross-sectional view showing a terminal block according to Embodiment 2.

As shown in FIG. 9, a release button port having a circular shape is provided in an upper portion of the housing 4 of the terminal block 11 according to one or more embodiments, instead of the tool insertion port 43, and a release button 7 is inserted into the release button port. The release button 7 is constituted by an operating portion 73, a transmitting portion 72, and an acting portion 71.

The acting portion 71 is formed into a rod-like shape having a larger diameter than the diameter of the release button port. The transmitting portion 72 is inserted into the release button port so as to be slidable within the release button port and protrudes upward therefrom. The operating portion 73 is formed at an upper end of the transmitting portion 72.

Figure 10:
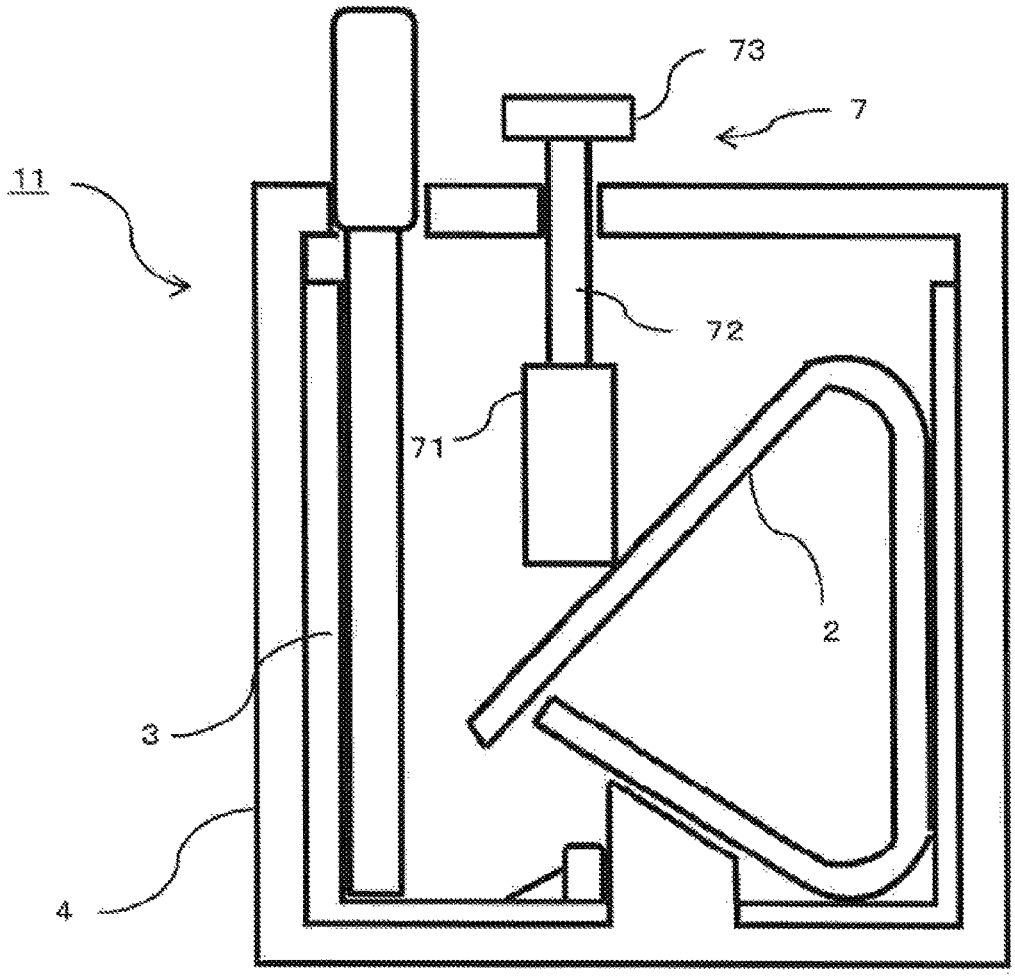
FIG. 10 is a diagram illustrating a case where a wire connected to a terminal block, such as in FIG. 9, is to be removed.
Figure 11:
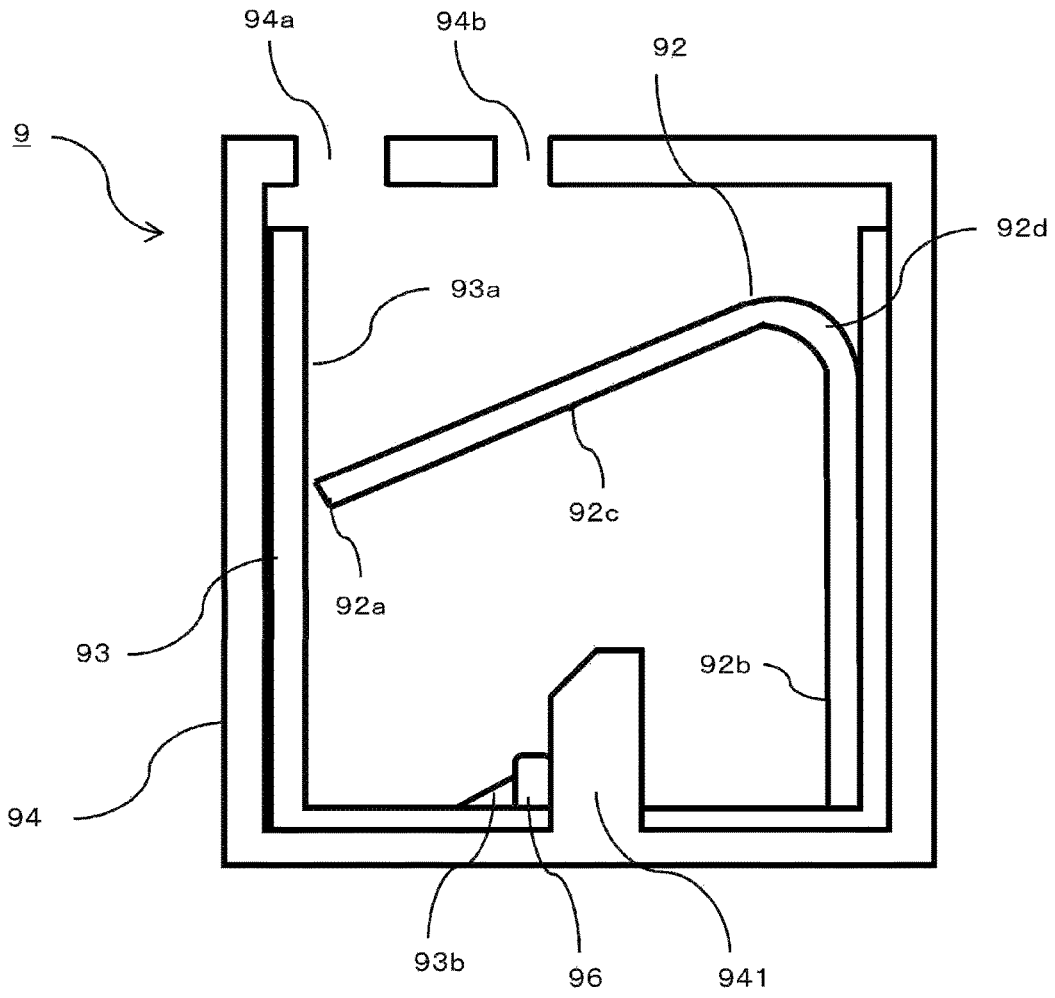
FIG. 11 is a cross-sectional view showing an example of a conventional terminal block.
Figure 12:
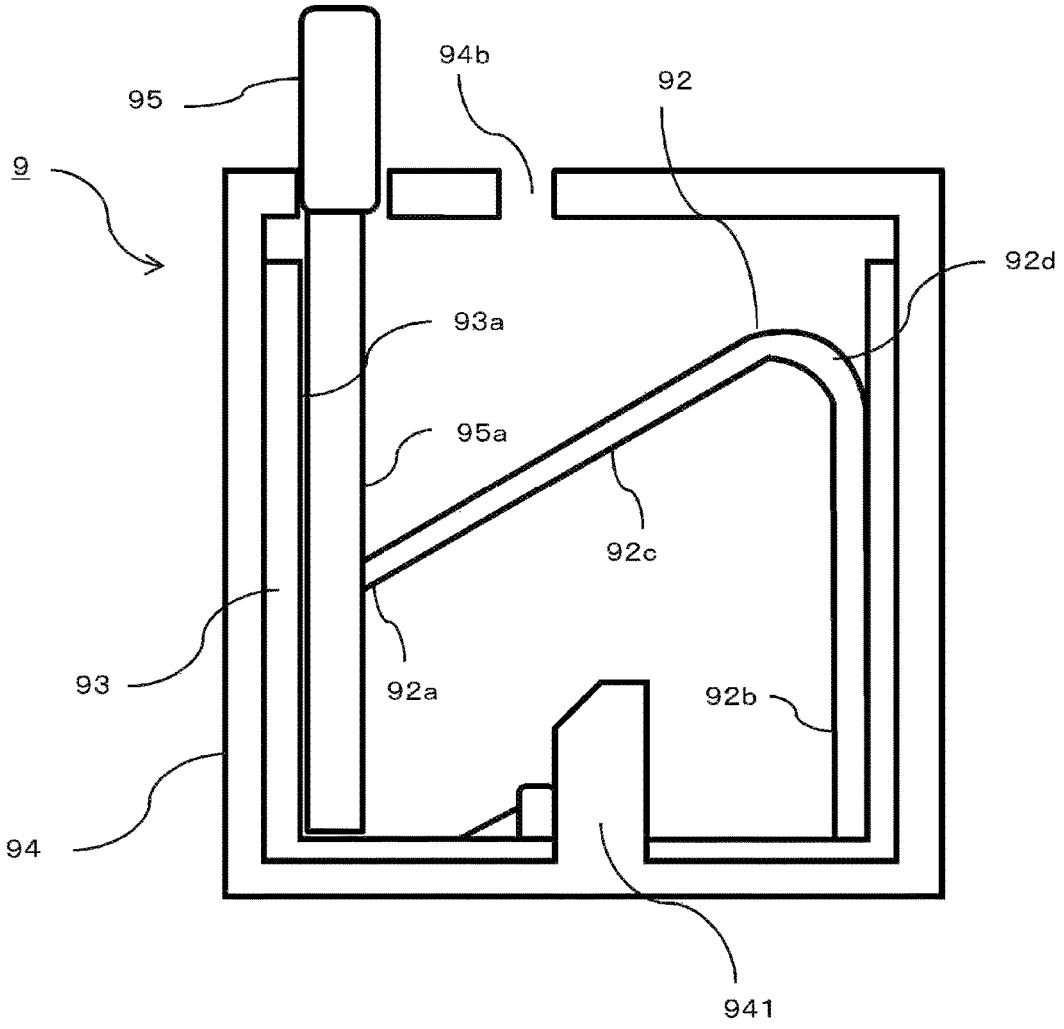
FIG. 12 is a diagram illustrating a case where a wire is connected to the terminal block shown in FIG. 11.
Figure 13:
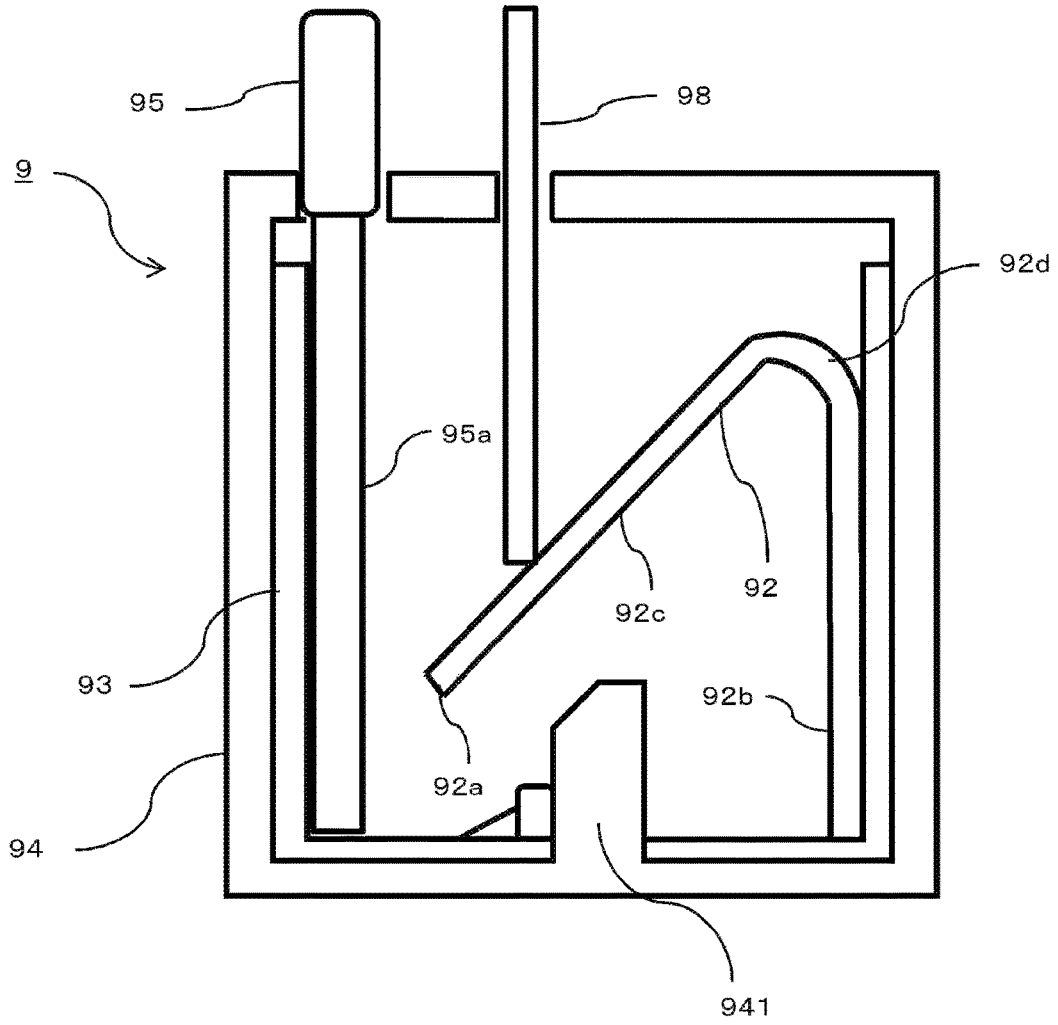
FIG. 13 is a diagram illustrating a case where the wire connected to the terminal block shown in FIG. 12 is to be removed.

FIG. 10 is a diagram for illustrating the terminal block 11 when the release button 7 is used. In the case where the wire 5 is to be detached from the terminal block 11 of one or more embodiments, and in the case where a wire with insufficient rigidity, such as a stranded wire, is to be inserted, the elastic deformation portion 21 is elastically deformed by pushing in the operating portion 73 of the release button 7. That is to say, when the operating portion 73 is pushed downward, the acting portion 71 pushes the elastic deformation portion 21 of the plate spring member 2 downward via the transmitting portion 72, and thus, the pressing portion 211 is separated from the connection surface 3*a*.

Then, when pushing of the operating portion 73 is stopped, the restoring force of the spring causes the elastic deformation portion 21 to return to its original position. Thus, the release button 7 is pushed back upward, and the upper end of the acting portion 71 engages with the inner wall in the upper portion of the housing and thus returns to its original state.

With the above-described configuration of the terminal block 11 according to one or more embodiments, the wire can be inserted and removed without the need to provide a tool separately, and thus the workability can be improved. It should be noted that a configuration in which a mechanism for separating the pressing portion of the plate spring from the connection surface of the terminal is provided in advance as in the case of one or more embodiments can also be employed in cases where the shape of the plate spring is different from that of one or more embodiments as in the modifications of Embodiment 1.

Others

The foregoing embodiments are presented to describe the present invention for illustrative purpose only, and the present invention is not limited to the above-described specific forms. Various modifications can be made to the present invention without departing from the technical idea of the invention. For example, it is not necessarily required that the housing of the terminal block is formed as a single member, and the housing may also be composed of a plurality of members such as a base member and a case. Moreover, although the terminal blocks of the foregoing embodiments have a single wire insertion port, a terminal block in which a plurality of wire insertion ports and plate spring members corresponding to the respective wire insertion ports are provided is also conceivable. Moreover, with regard to the material for the plate spring as well, although stainless steel is described as an example of the material in the foregoing embodiments, the material for the plate spring is not limited to this, and may be another metal or an alloy or may be carbon, a synthetic resin, or the like.

The invention claimed is:

1. A terminal block comprising:

a housing that has an opening into which a wire is to be inserted;

a terminal configured to be connected to the wire that is inserted through the opening; and a plate spring member configured to fix the wire by pressing the wire against the terminal, wherein:

the plate spring member is formed from a band-shaped metal plate and comprises:

a pressing portion opposed to the terminal and configured, in response to the wire being inserted through the opening in the housing, to press the wire against the terminal thereby sandwiching the wire between the pressing portion and the terminal; and a plastic deformation preventing portion configured to prevent the pressing portion from bending in a direction away from the terminal by more than a predetermined amount; and a bottom portion of the housing comprises a support having a slope that conforms to a surface of the plastic deformation preventing portion and supports the plastic deformation prevention portion so as to prevent bending of the plastic deformation preventing portion in response to a force applied to the plastic deformation preventing portion by the pressing portion.

2. The terminal block according to claim 1, wherein the plastic deformation preventing portion includes an end surface of the plate spring member, and in response to the pressing portion bending in the direction away from the terminal by the predetermined amount, the plastic deformation preventing portion prevents the pressing portion from bending any further by abutting the end surface of the plate spring member against a portion of the plate spring member.

3. The terminal block according to claim 1, wherein the plate spring member comprises bent portions at a plurality of positions in a longitudinal direction, and is disposed such that, prior to deformation, an inner surface of a first end portion of the plate spring member with respect to the longitudinal direction opposes an end surface of a second end portion of the plate spring member with respect to the longitudinal direction via a gap, the pressing portion is configured by a region that contains the first end portion of the plate spring member with respect to the longitudinal direction, the plastic deformation preventing portion is configured by a region that contains the second end portion of the plate spring member with respect to the longitudinal direction, and in response to the pressing portion of the plate spring member bending by the predetermined amount, the inner surface of the first end portion of the plate spring member with respect to the longitudinal direction abuts against the end surface of the plastic deformation preventing portion, which is the region of the plate spring member that contains the second end portion with respect to the longitudinal direction.

4. The terminal block according to claim 3, wherein the plate spring member comprises the bent portions at two positions of the plurality of positions in the longitudinal direction, comprises a triangular shape with a vicinity of one vertex being open when viewed in a width direction of the plate spring member, and is disposed such that, prior to deformation, an inner surface of an end portion of a first one of two sides of the triangular shape that are located on opposite sides of the opening opposes an end surface of an end portion of a second one of the two sides via the gap, the pressing portion is configured by a region that contains the end portion of the first one of the two sides of the triangular shape that are located on the opposite sides of the opening, the plastic deformation preventing portion is configured by a region that contains the end portion of the second one of the two sides of the triangular shape that are located on the opposite sides of the opening, and in response to the pressing portion of the plate spring member bending by the predetermined amount, the inner surface of the end portion of the first one of the two sides of the triangular shape that are located on the opposite sides of the opening abuts against the end surface of the end portion of the second one of the two sides of the triangular shape that are located on the opposite sides of the opening.

5. The terminal block according to claim 1, wherein the support is configured to prevent at least one of displacement and deformation of the plastic deformation preventing portion.

6. The terminal block according to claim 2, wherein the plate spring member comprises bent portions at a plurality of positions in a longitudinal direction, and is disposed such that, prior to deformation, an inner surface of a first end portion of the plate spring member with respect to the longitudinal direction opposes an end surface of a second end portion of the plate spring member with respect to the longitudinal direction via a gap, the pressing portion is configured by a region that contains the first end portion of the plate spring member with respect to the longitudinal direction, the plastic deformation preventing portion is configured by a region that contains the second end portion of the plate spring member with respect to the longitudinal direction, and in response to the pressing portion of the plate spring member bending by the predetermined amount, the inner surface of the first end portion of the plate spring member with respect to the longitudinal direction abuts against the end surface of the plastic deformation preventing portion, which is the region of the plate spring member that contains the second end portion with respect to the longitudinal direction.

7. The terminal block according to claim 6, wherein the plate spring member comprises the bent portions at two positions of the plurality of positions in the longitudinal direction, comprises a triangular shape with a vicinity of one vertex being open when viewed in a width direction of the plate spring member, and is disposed such that, prior to deformation, an inner surface of an end portion of a first one of two sides of the triangular shape that are located on opposite sides of the opening opposes an end surface of an end portion of a second one of the two sides via the gap, the pressing portion is configured by a region that contains the end portion of the first one of the two sides of the triangular shape that are located on the opposite sides of the opening, the plastic deformation preventing portion is configured by a region that contains the end portion of the second one of the two sides of the triangular shape that are located on the opposite sides of the opening, and in response to the pressing portion of the plate spring member bending by the predetermined amount, the inner surface of the end portion of the first one of the two sides of the triangular shape that are located on the opposite sides of the opening abuts against the end surface of the end portion of the second one of the two sides of the triangular shape that are located on the opposite sides of the opening.

8. The terminal block according to claim 2, wherein the support is configured to prevent at least one of displacement and deformation of the plastic deformation preventing portion.

9. The terminal block according to claim 3, wherein the support is configured to prevent at least one of displacement and deformation of the plastic deformation preventing portion.

10. The terminal block according to claim 4, further comprising:

the support being configured to prevent at least one of displacement and deformation of the plastic deformation preventing portion.

11. The terminal block according to claim 6, wherein the support is configured to prevent at least one of displacement and deformation of the plastic deformation preventing portion.

12. The terminal block according to claim 7, wherein the support is configured to prevent at least one of displacement and deformation of the plastic deformation preventing portion.

13. The terminal block according to claim 1, wherein the terminal comprises a first surface, a second surface opposed to and parallel to the first surface, and a third surface orthogonal to the first and second surfaces and connecting an end of the first surface and an end of the second surface, and the pressing portion of the plate spring member presses the wire against the first surface of the terminal thereby sandwiching the wire between the pressing portion and the first surface of the terminal.

14. The terminal block according to claim 13, wherein the plate spring member has a triangle shape comprising:

a fixation portion being a first flat plate portion fixed to the second surface of the terminal;

a plastic deformation portion being a second flat plate portion connected to one end of the fixation portion and comprising a leading end as the pressing portion; and the plastic deformation preventing portion being a third flat plate portion connected to the other end of the fixation portion.

15. The terminal block according to claim 14, wherein the plate spring member is disposed such that the fixation portion of the plate spring member is in contact with the second surface of the terminal and the plastic deformation preventing portion is in contact with the third surface of the terminal.

16. The terminal block according to claim 14, further comprising:

a release button inserted in a release button port of the housing and configured, when being pressed down, to push the plastic deformation portion of the plate spring member to move the pressing portion away from the first surface of the terminal.

17. The terminal block according to claim 16, wherein the release button further comprises:

a transmitting portion slidably inserted in the release button port;

an acting portion connected to one end of the transmitting portion provided inside of the housing; and an operating portion connected to the other end of the transmitting portion provided outside of the housing.

* * * * *